United States Patent [19]

Niemiro et al.

[11] Patent Number: 5,027,706

[45] Date of Patent: Jul. 2, 1991

[54] PRESS INKING SYSTEM

[75] Inventors: Thaddeus A. Niemiro, Lisle; Frederick J. Whiting, LaGrange, both of Ill.

[73] Assignee: Rockwell International Corporation, Pittsburgh, Pa.

[21] Appl. No.: 391,815

[22] Filed: Aug. 9, 1989

Related U.S. Application Data

[63] Continuation of Ser. No. 223,820, Jul. 11, 1988.

[51] Int. Cl.[5] ..... B41F 31/08; B41F 33/16; B41L 27/10

[52] U.S. Cl. ..... 101/366; 101/148

[58] Field of Search ..... 101/366, 365, 207, 208, 101/209, 210, DIG. 45, 148, 147, 142, 181

[56] References Cited

U.S. PATENT DOCUMENTS 4,469,024 9/1984 Schwartz et al. ..... 101/366

FOREIGN PATENT DOCUMENTS 587039 11/1932 Fed. Rep. of Germany ..... 101/366
14749 1/1983 Japan ..... 101/365

*Primary Examiner*—J. Reed Fisher
*Attorney, Agent, or Firm*—Quarles & Brady

[57] ABSTRACT

An inking system having continuously operating individual positive displacement ink pumps for each column of print and means for applying ink to the ink roll in discrete, timed quantities which are determined by a microprocessor-based control system.

4 Claims, 13 Drawing Sheets

13
12
LOCAL PANEL
53
COMMUNICATION PROCESSOR
30
31
PRESS MONITOR & CONTROL
35D
LEVEL 'D' DRINK PROCESSOR
35C
LEVEL C DRINK PROCESSOR
35B
LEVEL B DRINK PROCESSOR
35A
LEVEL A DRINK PROCESSOR
29
SPEED SENSOR
36

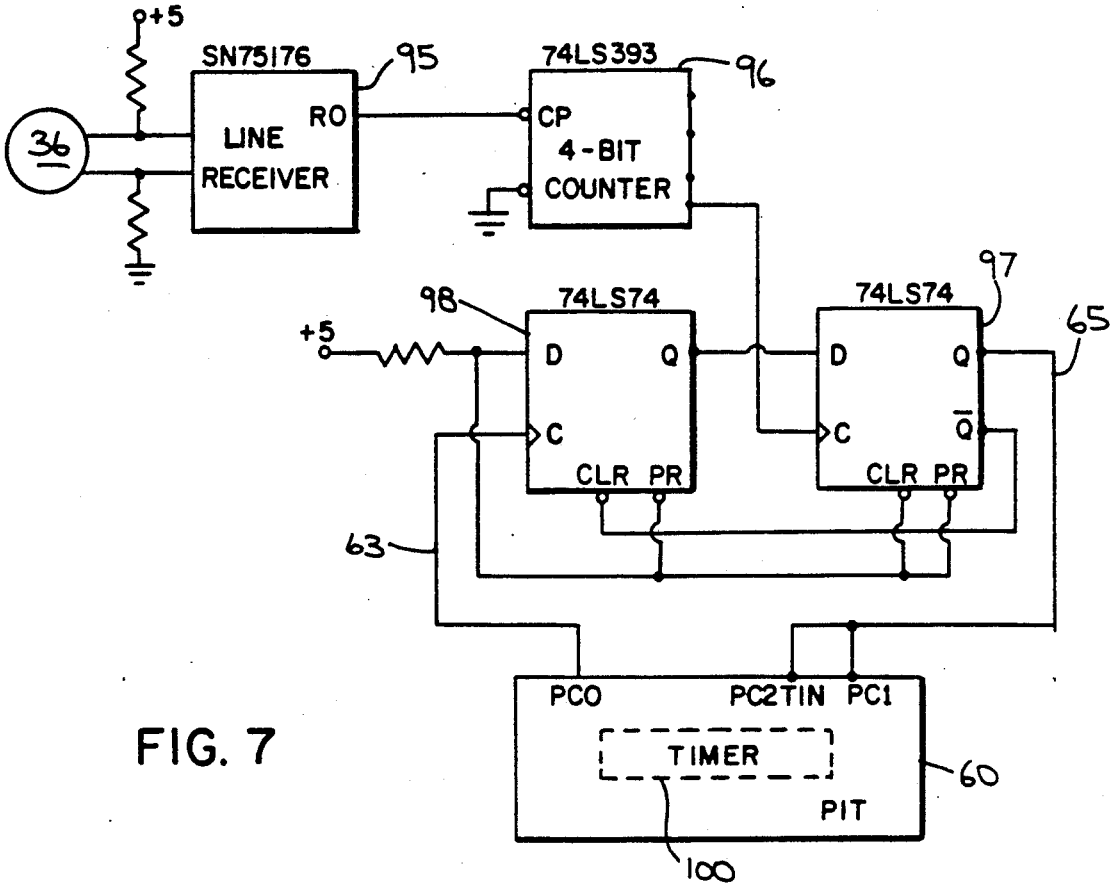
FIG. 7
FIG. 14
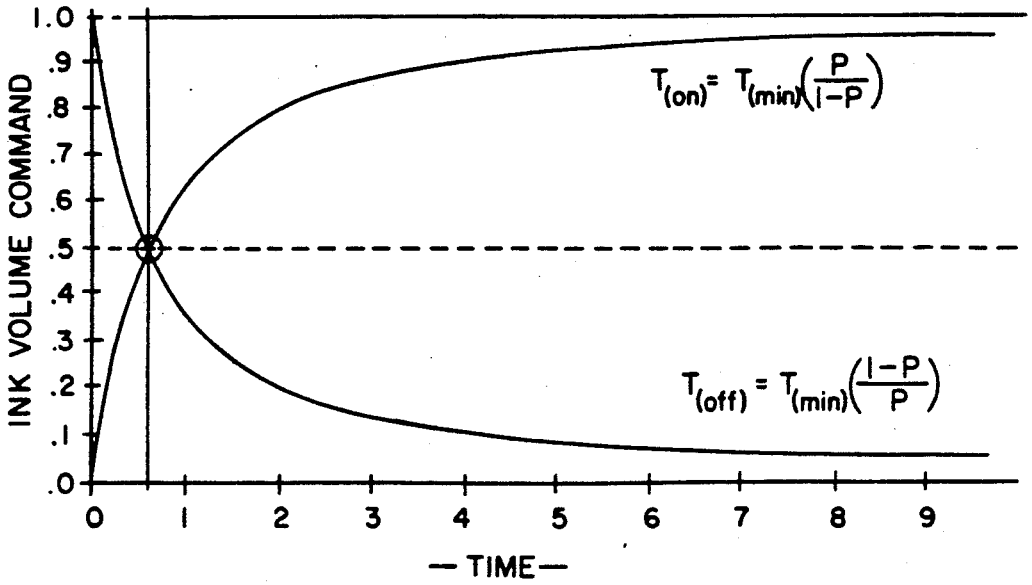

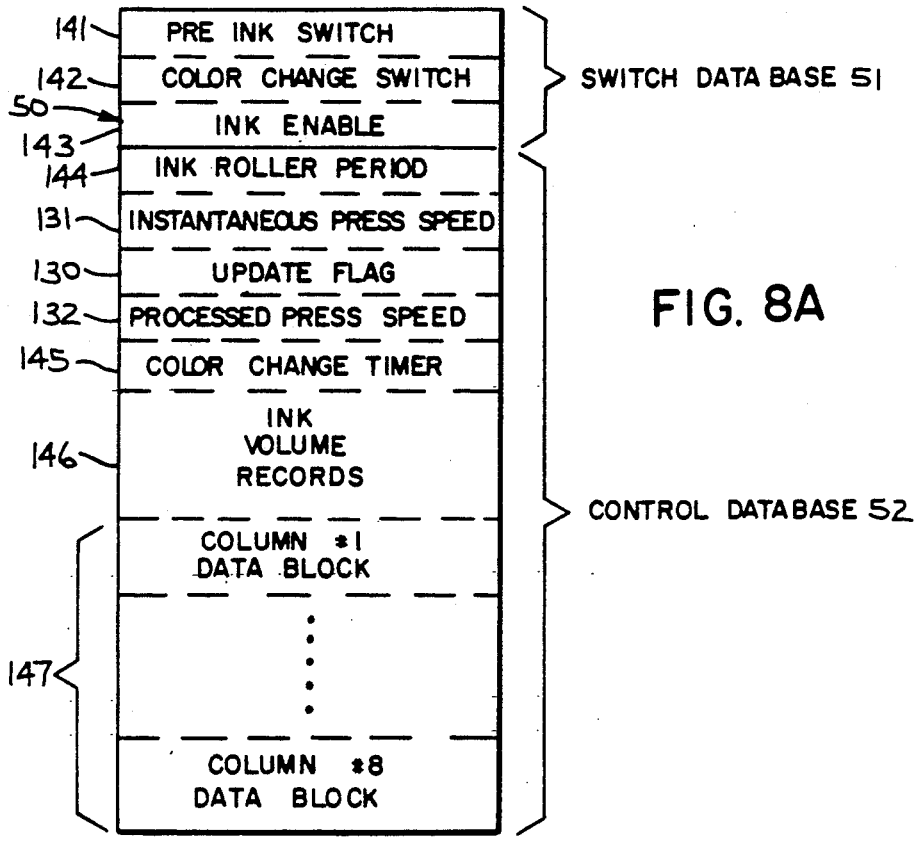
FIG. 8A
FIG. 8B
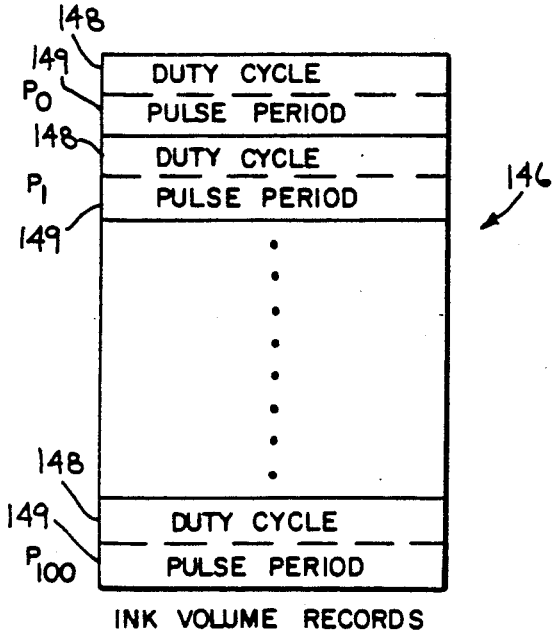
FIG. 8C
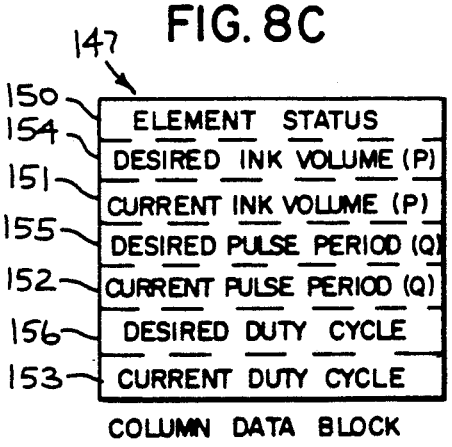

SPEED FEEDBACK PROCESS

INKER

MESSAGE HANDLER

INKER CONTROL PROCESS

PRESS INKING SYSTEM

This is a continuation of application Ser. No. 223,820, filed July 11, 1988.

BACKGROUND OF THE INVENTION

The present invention relates to offset printing presses and, particularly, to the electronic control of ink supplied by such presses.

Web offset printing presses have gained widespread acceptance by metropolitan daily as well as weekly newspapers. Such presses produce a quality black and white or color product at very high speeds. To maintain image quality, a number of printing functions must be controlled very precisely as the press is operating. These include the control of press speed, the control of color register, the control of ink flow and the control of dampening water.

In all printing processes there must be some way to separate the image area from the non-image area. This is done in letterpress printing by raising the image area above the non-image area and is termed "relief printing". The ink roller only touches the high part of the plate, which in turn, touches the paper to transfer the ink. In offset lithography, however, the separation is achieved chemically. The lithographic plate has a flat surface and the image area is made grease-receptive so that it will accept ink, and the non-image area is made water-receptive so it will repel ink when wet.

In a web offset printing press the lithographic plate is mounted to a rotating plate cylinder. The ink is injected onto an ink pickup roller and from there it is conveyed through a series of transfer rollers which spread the ink uniformly along their length and transfer the ink to the image areas of the rotating plate. Similarly, dampening water is applied to a fountain roller and is conveyed through one or more transfer rollers to the non-image areas of the rotating plate cylinder. The plate cylinder rotates in contact with a blanket cylinder which transfers the ink image from the plate cylinder to the moving paper web.

It is readily apparent that the amount of ink and dampening water supplied to the plate cylinder is directly proportional to the press speed. At higher press speeds the plate cylinder and blanket cylinder transfer ink and water to the paper web at a higher rate, and the inking and dampening systems must, therefore, supply more ink and water. It is also well known that this relationship is not linear and that the rate at which ink and dampening water is applied follows a complex rate curve which is unique to each press and may be unique to each run on a press. Not so apparent is the fact that the ink and water may be applied nonuniformly across the width of the ink pickup roller and the fountain roller in order to achieve uniform printing quality along the width of the web. If this is not done, there may be significant changes in the quality of the printed images across the width of the moving web.

Ink is normally supplied to web fed printing presses from an ink fountain onto a fountain roller that is in operative contract with a ductor roller which forwards the ink to the remaining ink train rollers. The feeding of ink into a press, particularly one using the lithographic process, is a demanding operation, yet one which is vital to successful printing. The oil base inks which are used in offset lithography are very viscous, in many cases being more plastic than fluid. This physical property of these inks is one reason why ink is supplied to the plate roller through a train, i.e., so that the viscous nature can be reduced and a uniform film of ink presented to the plate The application of ink to the fountain roller has been commonly regulated by means of a blade which forms one wall of the ink fountain. The free end of this blade is adjustable by means of a manually or motor operated adjusting screw. This type of system is generally referred to as being a keyed inker and it is capable of controlling the amount of ink that is presented to each column of print across the width of the plate roll.

A more recent development is that of supplying ink to an ink rail by means of individual gear pumps that are mounted directly on the rail; one for each column of print. This type of ink supply which is shown in U.S. Pat. No. 4,281,597, regulates the amount of ink supplied to each column by varying the speed of the drive motor operating the gear pump associated with each print column. Adjustment in the speed of the motors can be performed either manually or automatically. Additional types of keyed inkers where generally a pump or a piston is used to deliver the ink through suitable dispensing nozzles onto the ink roller are disclosed in U.S. Pat. Nos. 2,981,182; 2,081,906; 3,207,070 and 2,130,659.

SUMMARY OF THE INVENTION

The present invention relates to a control system for an offset printing press and, particularly, to an inking system on such a press. More particularly, the present invention includes an ink supply; a positive displacement pump connected to the ink supply; an ink rail having a set of ink outlet orifices positioned to supply ink to a corresponding set of print columns; valves connected between the pump and each ink outlet orifice; and a controller which is responsive to an ink volume command for each column to control each valve and to thereby provide timed discharges of ink through each ink outlet orifice which corresponds to the ink volume commands.

It is a principal object of this invention to provide a press inking system that provides greater ink control than has heretofore been possible.

It is an additional object of this invention to provide a press inking system that has fewer parts.

It is a further object of this invention to provide a press inking system that provides a pulsed ink injection onto the roller in amounts satisfying ink requirements for each print column.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 7 is an electrical schematic diagram of a speed interface circuit which forms part of the drink processor of FIG. 5;

FIGS. 8A–C are schematic representations of important data structures which are stored in the RAM of FIG. 5;

FIG. 14 is a graph illustrating the nature of ink coverage effect by the inking system as a function of ink flow "on and off" rates.

DESCRIPTION OF THE PREFERRED EMBODIMENT

Figure 1:
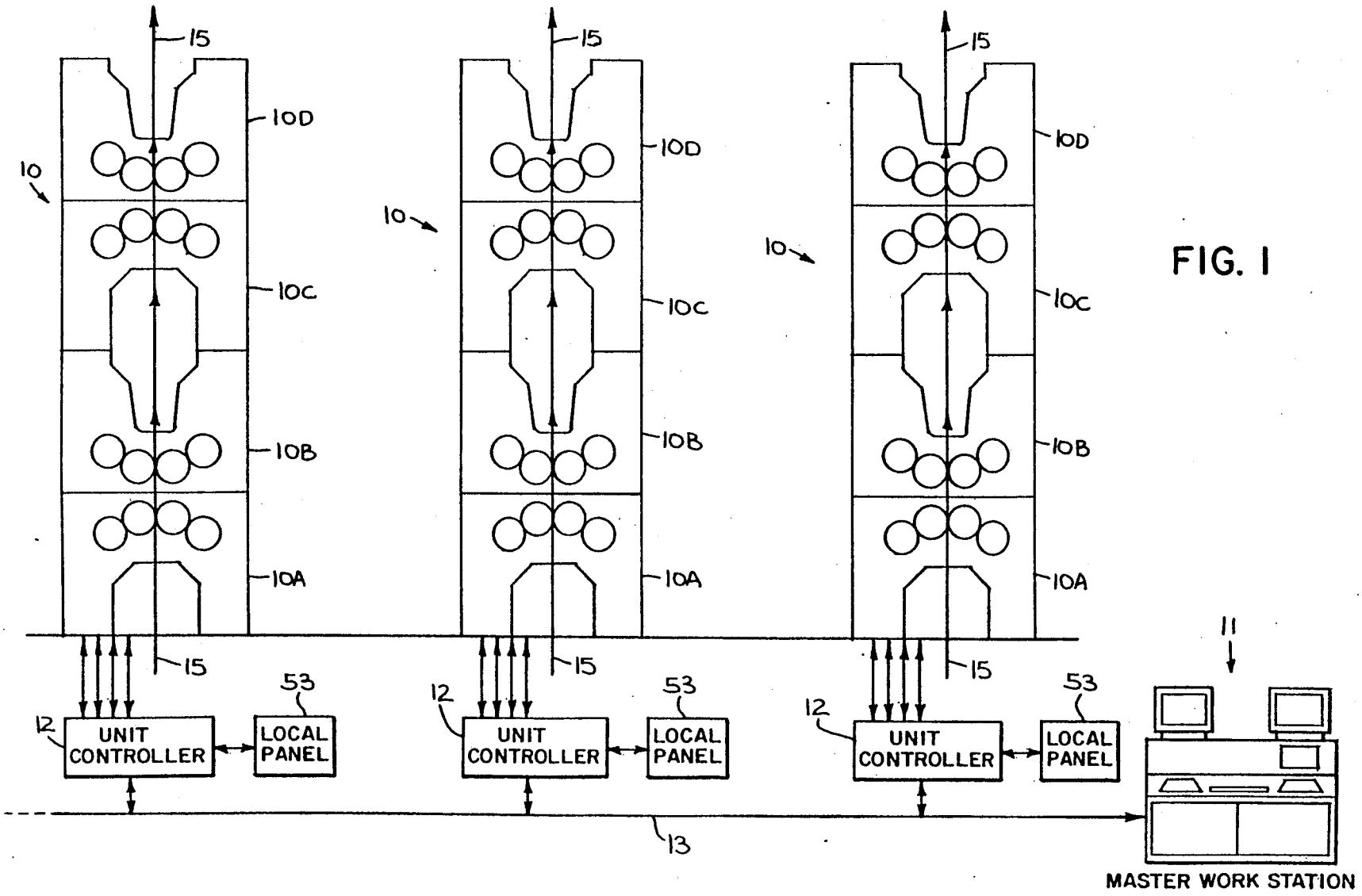
FIG. 1 is a schematic representation of a web offset printing press and its control system.

Referring particularly to FIG. 1, a printing press is comprised of one or more printing units 10 which are controlled from a master work station 11. Each printing unit is linked to the master work station by a unit controller 12 which communicates through a local area network 13. As described in U.S. Pat. No. 4,667,323, the master work station 11 and the unit controllers 12 may send messages to each other through the network 13 to both control the operation of the press and to gather production information.

Figure 2:
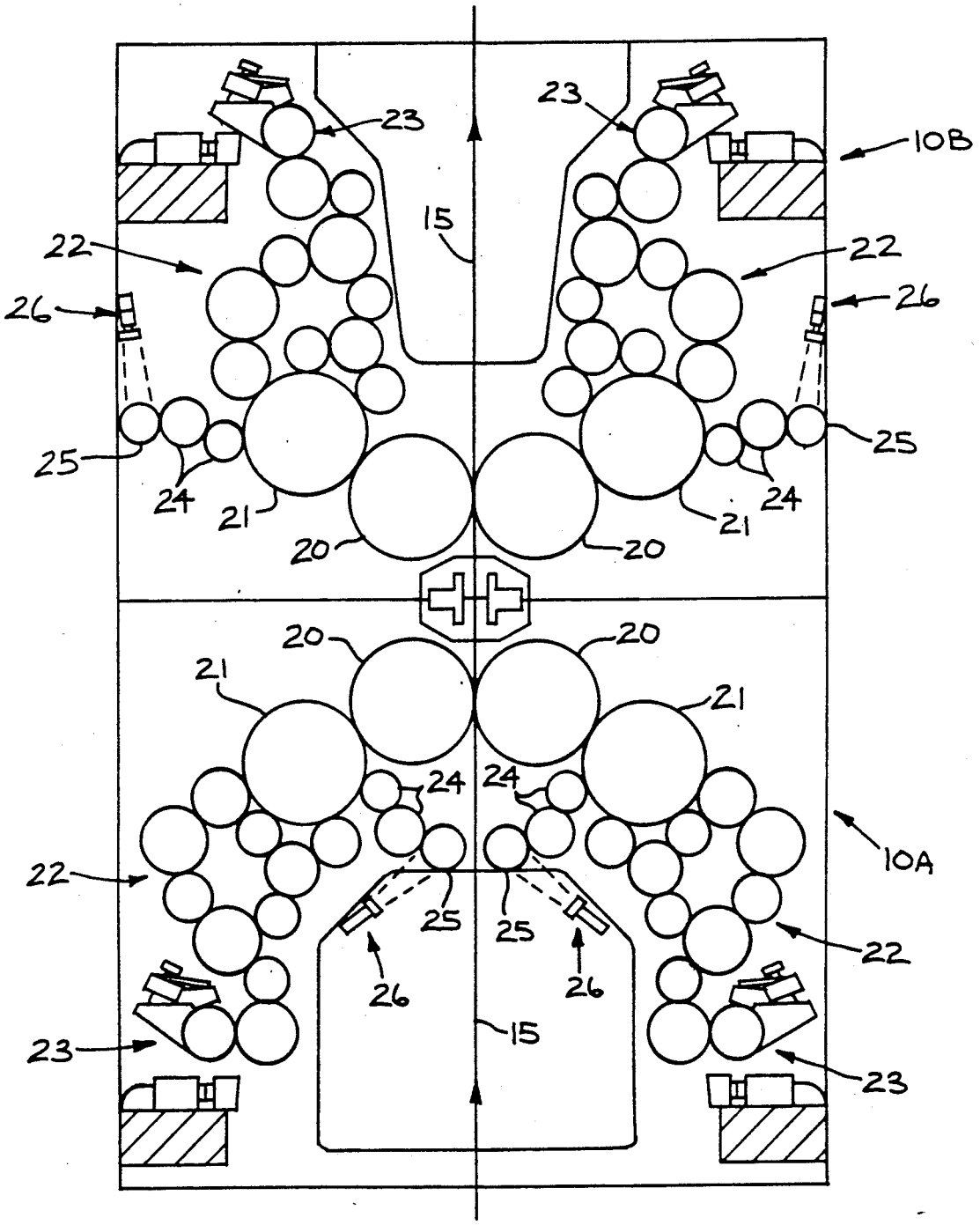
FIG. 2 is a schematic representation of two printing units in the press of FIG. 1.

Referring particularly to FIGS. 1 and 2, each printing unit 10 is comprised of four units which are referred to as levels A, B, C and D and which are designated herein as units 10A, 10B, 10C and 10D. The units 10A–D are stacked one on top of the other and a web 15 passes upward through them for printing on one or both sides. In the preferred embodiment shown, the printing units 10 are configured for full color printing on both sides of the web, where the separate units 10A–D print the respective colors blue, red, yellow and black.

As shown best in FIG. 2, each unit 10A–D includes two printing couples comprised of a blanket cylinder 20 and a plate cylinder 21. The web 15 passes between the blanket cylinders 20 in each unit for printing on both sides. Ink is applied to each plate cylinder 21 by a series of ink transfer rollers 22 which receive ink from an ink fountain roller 23. As is well known in the art, the ink transfer rollers 22 insure that the ink is distributed uniformly along their length and is applied uniformly to the rotating plate cylinder 21. Similarly, each plate cylinder 21 is supplied with dampening water by a pair of dampener transfer rollers 24 and a dampener rider roller 25. A spray bar assembly 26 applies dampening water to each of the dampener rider rollers 25.

Figure 3:
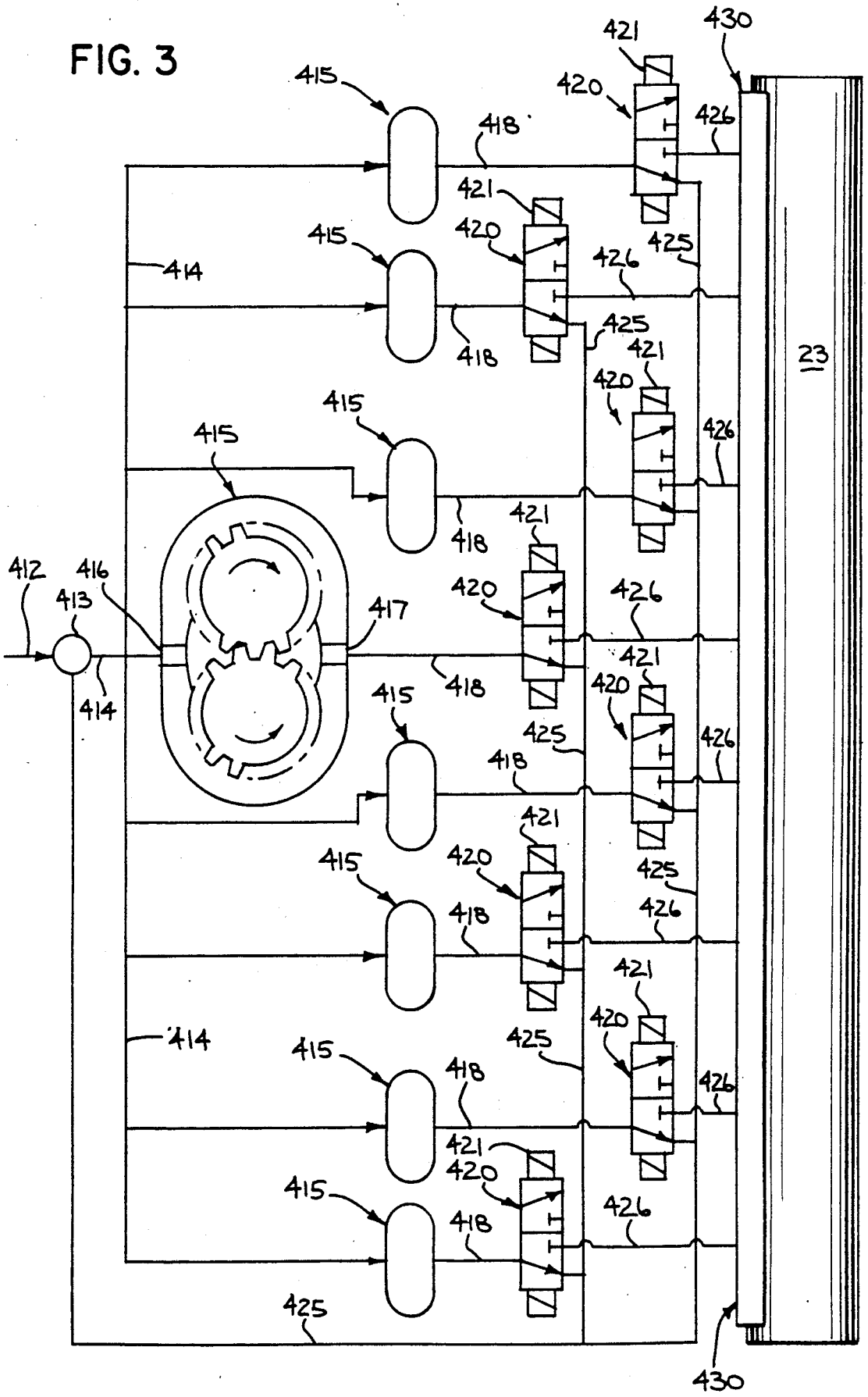
FIG. 3 is a pictorial view of an ink supply system which is employed in the printing units of FIG. 2.

Referring particularly to FIG. 3, the inking system which supplies ink to the ink roller 23 includes a supply of ink 412 which enters into a supply manifold 413. From the manifold 413, a series of supply pipes 414 direct the ink into respective positive displacement ink pumps 415 at an inlet side 416. The pumps 415 are gear pumps, which is a type of pump well suited for the purpose of moving the highly viscous printing ink, and there is one pump 415 for each of eight columns of print. All of the pumps 415 are connected through gears for rotation by the press, and their speed is thus proportional to press speed. Normally, in the printing of articles such as daily newspapers, there are a plurality of columns of print, the exact number depending upon the size of the newspapers and whether the press is of single or double width.

From the outlet side 417 of each pump 415, a conduit, or pipe, 418 directs the ink into a valve 420. Valve 420 is operable by means of a solenoid coil 421. From the valve 420 there is an ink bypass conduit 425 that returns ink to the manifold 413 when the valve 420 is in what is considered the "off" position. In the other position, the "on" position, the valve 420 directs ink through ink conduit 426 into an ink rail 430. Ink rail 430 provides the ink to the ink roller 23 through an ink outlet orifice at each of the plurality of columns that are to be printed by the plate cylinder 21.

The operation of this inking system is such that ink from supply 412 is made available to the series of gear pumps 415 which continuously pump ink into the respective conduits 418 at a rate proportional to press speed. Each of the eight valves 420 may be independently controlled by energizing its solenoid 421 to direct ink flow to the ink rail 430 or de-energizing its solenoid 421 to divert ink flow back to the manifold 413.

As mentioned, each valve means 420 basically operates between two positions, these being one in which ink is permitted to go through to the ink rail 430 and the other being the position illustrated in FIG. 3 where the ink flow is sent through the bypass 425 to return to the supply manifold 413. In operation, the valves 420 are turned on and off at a controlled pulse rate, and the "on" time is controlled as a function of print density. For example, if the printing is of high density that requires a great deal of ink, then the control system will cause the valve 420 to be opened a length of time that will supply more ink to the ink rail 430 in the given column than it would for a column that is of light print density. This inking system is a digital system that supplies the ink to the ink roll 23 in a timed series of bursts.

Figure 4:
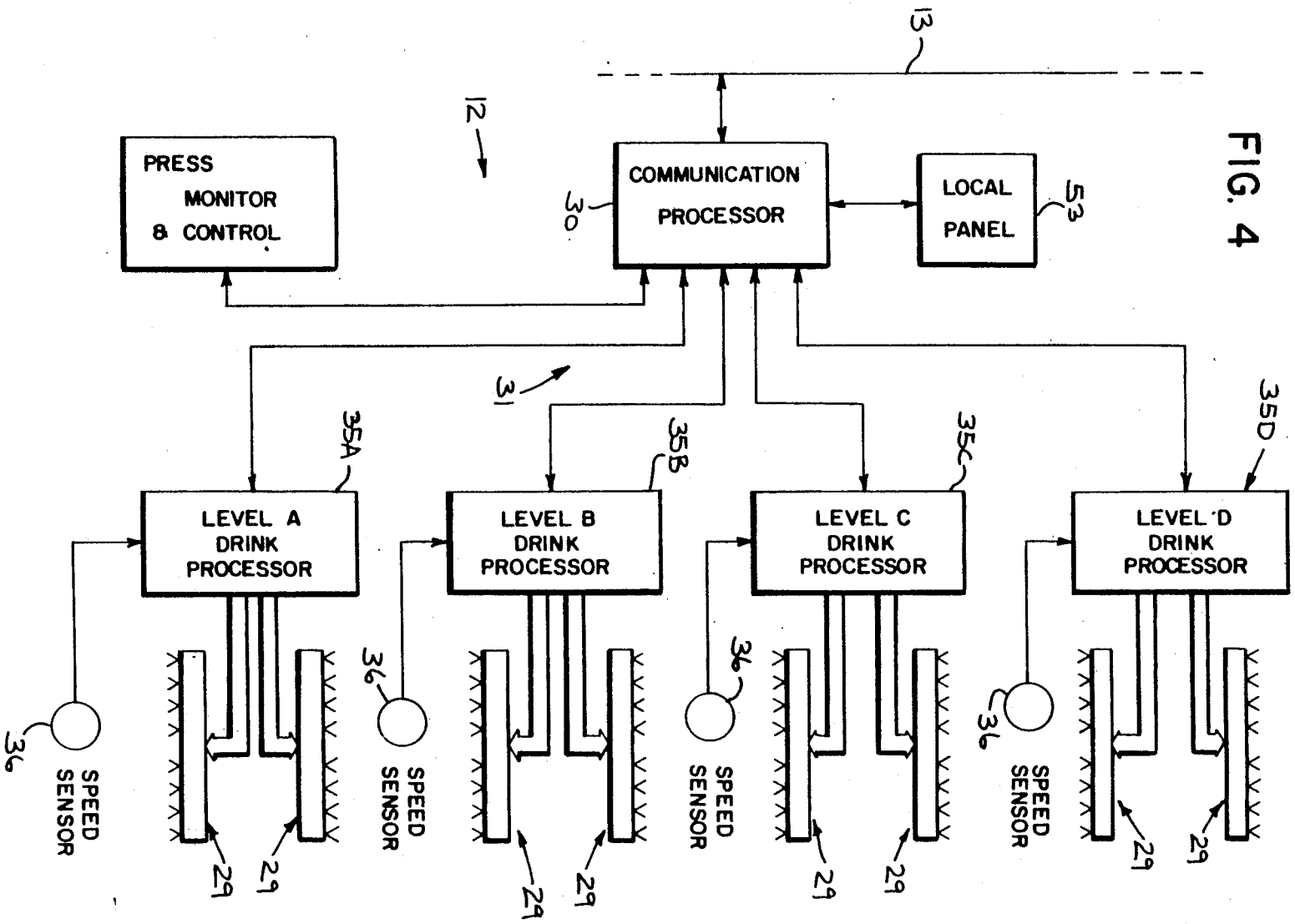
FIG. 4 is an electrical block diagram of a unit controller which forms part of the press control system of FIG. 1.

Referring to FIGS. 1 and 4, the solenoids 421 in the inking system 29 are operated by the unit controllers 12. Each unit controller includes a communications processor 30 of the type disclosed in the above-cited U.S. Pat. No. 4,667,323 which interfaces with the local area network 13. The communications processor 30 provides six serial communications channels 31 through which it can receive input messages for transmission on the network 13. Messages which are received through the network 13 by the communications processor 30 are distributed to the appropriate serial channel 30. The serial communications channels 30 employ a standard RS 422 protocol.

Four of the serial channels 30 connect to respective drink processors 35A, 35B, 35C and 35D. Each drink processor 35 is coupled to sensing devices and operating devices on a respective one of the levels A–D of the printing unit 10. In addition to receiving a press speed feedback signal from a speed sensor 36 mounted on the units 10A–D, each drink processor 35A–D produces output signals which control the solenoids 421 on the inking system 29. The drink processors 35A–D also control the solenoid valves which operate the spray bars 26 and they control color register. These latter functions will not be described in any detail in this specification, and for a more detailed description of the water dampening control system, reference is made to U.S. patent application Ser. No. 191,621, which was filed on May 9, 1988, and which is entitled "Microprocessor Based Press Dampening Control".

DESCRIPTION OF THE HARDWARE

Figure 5:
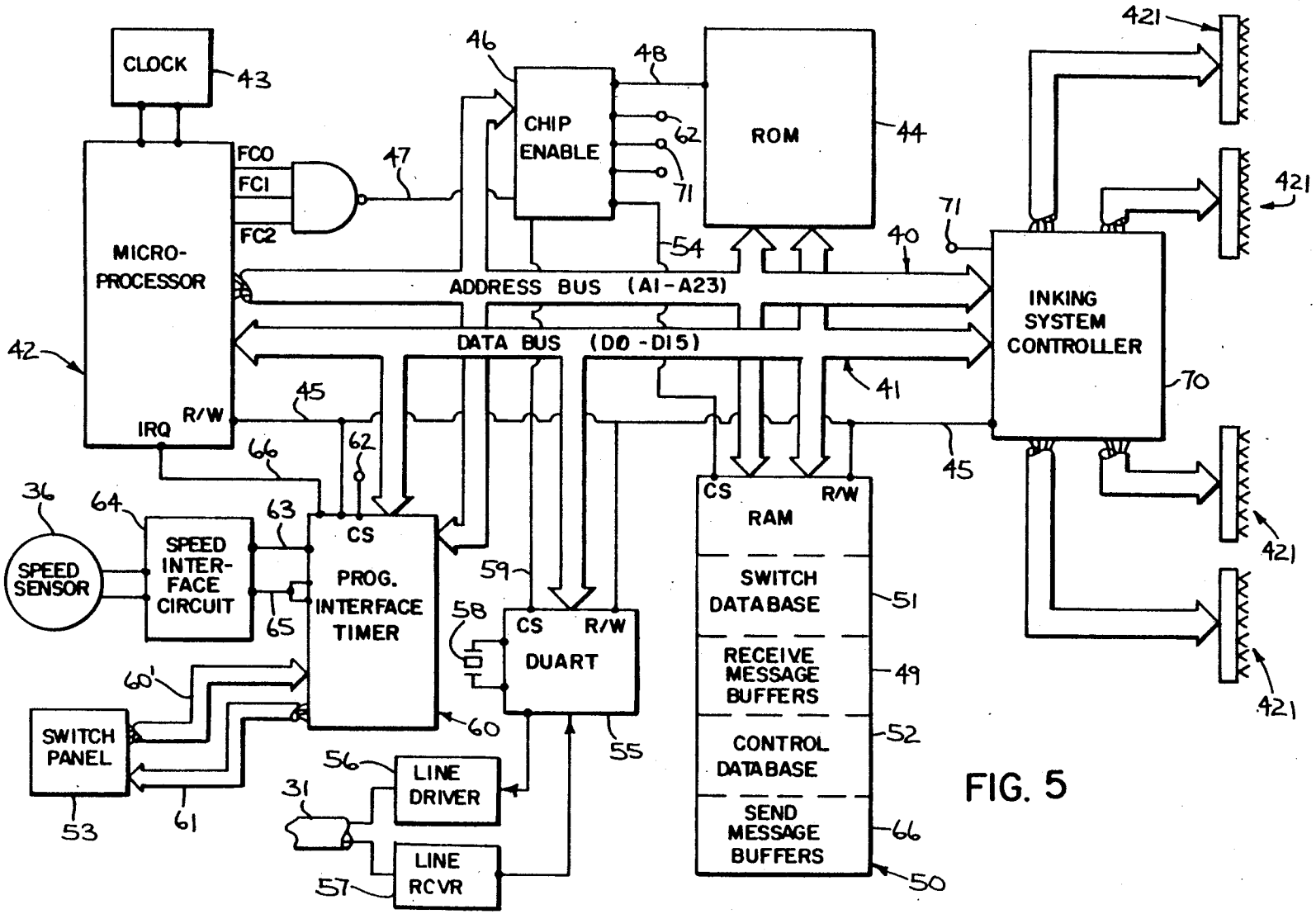
FIG. 5 is an electrical schematic diagram of a drink processor which forms part of the unit controller of FIG. 4.

Referring particularly to FIG. 5, each drink processor 35 is structured about a 23-bit address bus 40 and a 16-bit data bus 41 which are controlled by a 16-bit microprocessor 42. The microprocessor 42 is a model 68000 sold commercially by Motorola, Inc. which is operated by a 10 mHz clock 43. In response to program instructions which are stored in a read-only memory (ROM) 44, the microprocessor 42 addresses elements of the drink processor 35 through the address bus 40 and exchanges data with the addressed element through the data bus 41. The state of a read/write (R/W) control line 45 determines if data is read from the addressed element or is written to it. Those skilled in the art will recognize that the addressable elements are integrated circuits which occupy a considerable address space. They are enabled by a chip enable circuit 46 when an address within their range is produced on the address bus 40. The chip enable circuit 46 is comprised of logic gates and three PAL16L8 programmable logic arrays sold commercially by Advanced Micro Devices, Inc. As is well known in the art, the chip enable circuit 46 is responsive to the address on the bus 40 and a control signal on a line 47 from the microprocessor 42 to produce a chip select signal for the addressed element. For example, the ROM 44 is enabled through a line 48 when a read cycle is executed in the address range $F00000 through $F7FFFF. The address space occupied by each of the addressable elements in the drink processor 35 is given in Table A.

TABLE A

| | | | |
|---|---|---|---|
| ROM 44 | $F00000 | to | $F7FFFF |
| RAM 50 | $000000 | to | $06FFFF |
| Programmable Interface | | | |
| Timer 60 | $300340 | to | $30037F |
| Timer 100 | $300360 | | |
| PC0 | $300358 | | |
| PC1 | $300358 | | |
| Inking System Controller 70 | $300700 | to | $3007FF |
| DUART 55 | $200000 | to | $20003F |

Referring still to FIG. 5, whereas the ROM 44 stores the programs or "firmware" which operates the microprocessor 42 to carry out the functions of the drink processor 35, a read/write random access memory (RAM) 50 stores the data structures which are employed to carry out these functions. As will be described in more detail below, these data structures include elements which are collectively referred to herein as a switch database 51, a control database 52, receive message buffers 49, and send message buffers 66. For example, the switch database 51 indicates the status of various switches on the local control panels 53, whereas the control database 52 stores data indicative of press speed, solenoid pulse rate, and solenoid pulse width. The RAM 50 is enabled for a read or write cycle with the microprocessor 42 through a control line 54.

The drink processor 35 is coupled to one of the serial channels 31 of the communications processor 30 by a dual universal asynchronous receiver/transmitter (DUART) 55. The DUART 55 is commercially available as an integrated circuit model 68681 from Motorola, Inc. It operates to convert message data written to the DUART 55 by the microprocessor 42 into a serial bit stream which is applied to the serial channel 31 by a line drive circuit 56 that is compatible with the RS 422 standard. Similarly, the DUART 55 will receive a serial bit stream through a line receiver 57 and convert it to a message that may be read by the microprocessor 42. The DUART 55 is driven by a 3.6864 mHz clock produced by a crystal 58 and is enabled for either a read or write cycle through control line 59.

The press speed feedback signal as well as signals from the local switch panel 53 are input to the drink processor 35 through a programmable interface timer (PIT) 60. The PIT 60 is commercially available in integrated circuit form as the model 68230 from Motorola, Inc. It provides two 8-bit parallel ports which can be configured as either inputs or outputs and a number of separate input and output points. In the preferred embodiment, one of the ports is used to input switch signals from the switch panel 53 through lines 60, and the second port is used to output indicator light signals to the switch panel 53 through lines 61. The PIT 60 is enabled through control line 62 and its internal registers are selected by leads A0-A4 in the address bus 40.

In addition to the parallel I/O ports, the PIT 60 includes a programmable timer/counter. This timer may be started and stopped when written to by the microprocessor 42 and it is incremented at a rate of 312.5 kHz by an internal clock driven by the 10 mHz clock 43. When the timer is started, a logic high pulse is also produced at an output 63 to a speed interface circuit 64. When the interface circuit 64 subsequently produces a pulse on input line 65, the timer stops incrementing and a flag bit is set in the PIT 60 which indicates the timer has stopped. This flag bit is periodically read and checked by the microprocessor 42, and when set, the microprocessor 42 reads the timer value from the PIT 60 and uses it to calculate current press speed.

Referring still to FIG. 5, the solenoid valves 421 on the inking system 29 are operated by an inking system controller 70 which connects to the buses 40 and 41. The inking system controller 70 occupies sixty-four contiguous addresses as indicated above in Table A, and it is enabled by control line 71 from the chip enable circuit 46 when any of these addresses is produced on address bus 40. As will be described in more detail below, a 16-bit data word may be written to any of the sixty-four addressable locations when the read/write control line 45 is driven low by microprocessor 42, and a 5-bit status word is read from the controller 70 when a read cycle is performed and any one of the sixty-four inking system controller addresses is generated on address bus 40.

Figure 6:
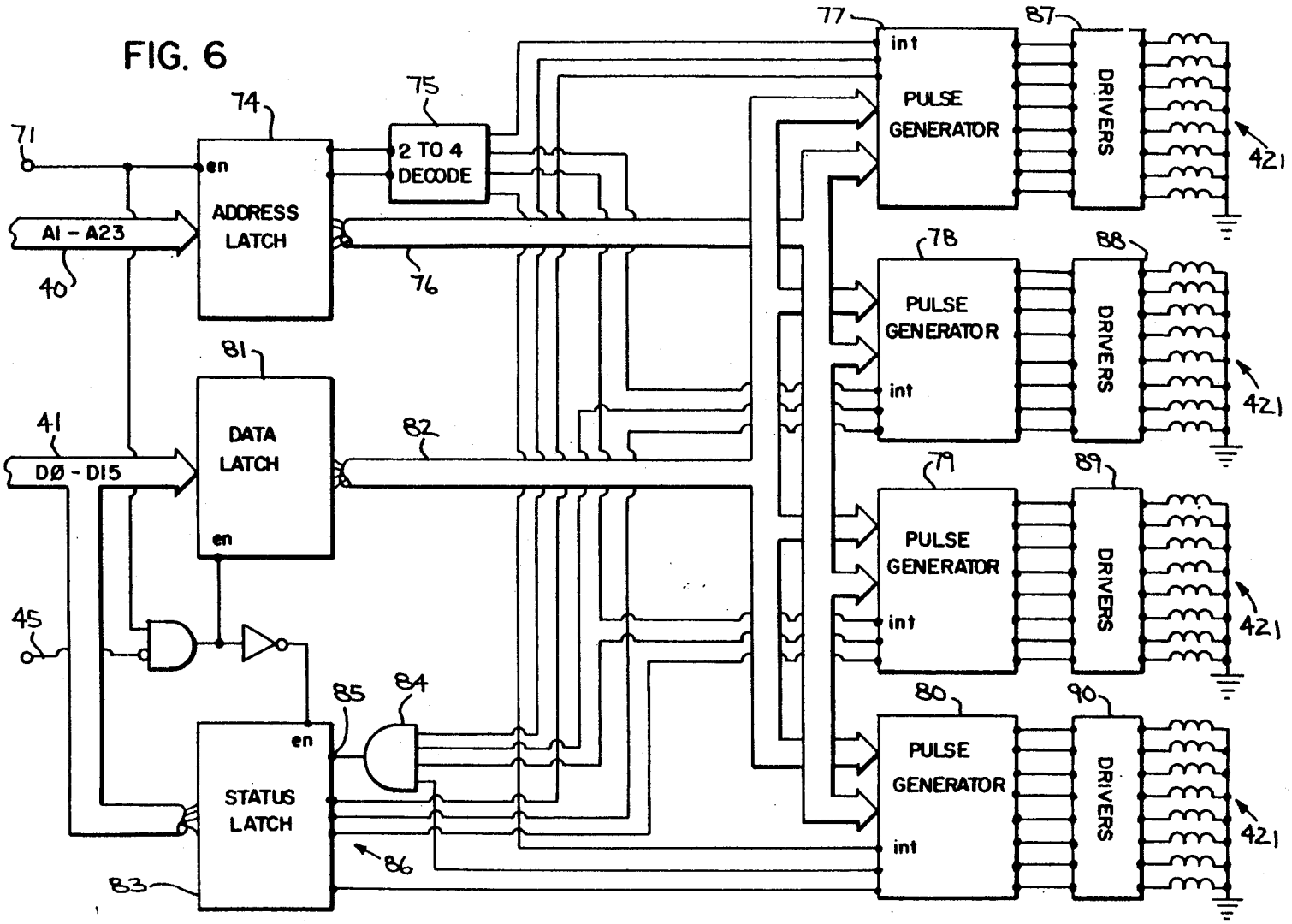
FIG. 6 is an electrical schematic diagram of an inking system controller which forms part of the drink processor of FIG. 5.
Figure 9:
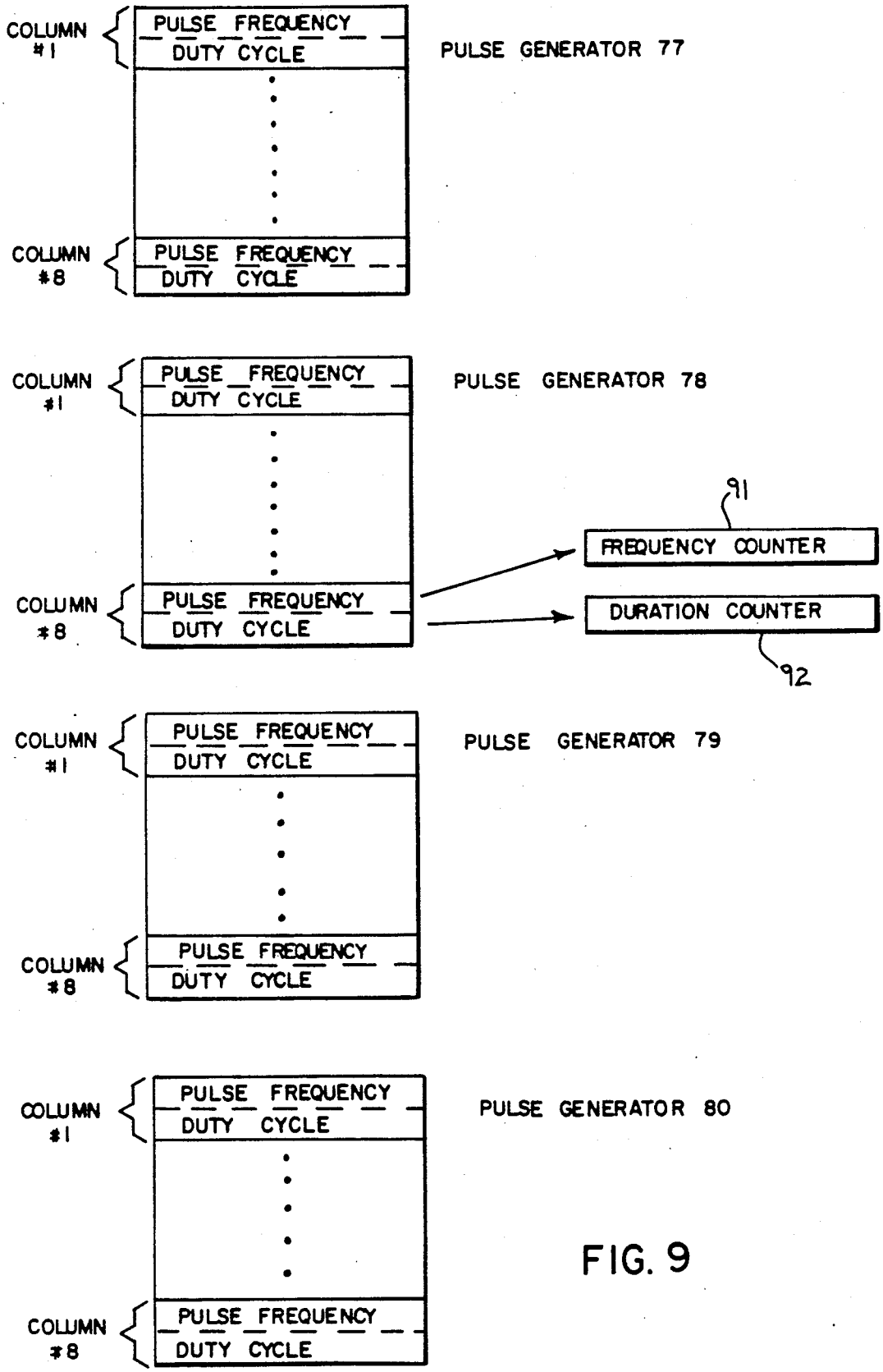
FIG. 9 is a pictorial representation of data structures in the pulse generators which form part of the inking system controller of FIG. 6.

Referring particularly to FIG. 6, the inking system controller 70 is shown in more detail and includes an address latch 74 which connects to the address bus 40 and is enabled through chip enable line 71. Two bits of the latched address are applied to a two-line-to-four-line decoder 75 and the remaining four least significant bits are applied to bus 76. The four outputs of decoder 75 connect to interrupt request inputs on respective pulse generators 77–80 and when the inking controller 70 is addressed, one of the pulse generators is interrupted. The bus 76 connects to each pulse generator 77–80, and the first function of an interrupted pulse generator is to read the 4-bit address thereon to select one of sixteen separately addressable memory locations therein. A map of these sixteen memory locations is illustrated in FIG. 9 and will be described in more detail below.

The data bus 41 is coupled to a -16-bit data latch 81 which is enabled when the inking controller 70 is addressed and the read/write control line 45 is in its write state. As a result, a 16-bit data word is stored in the data latch 81 and is produced at its sixteen outputs that connect to a 16-bit data bus 82. The data bus 82 connects to each pulse generator 77–80, and when interrupted, the second function of each pulse generator 77–80 is to read the 16-bit data word from the latch 81.

An 8-bit status latch 83 also connects to the drink processor data bus 41 and it is enabled when the inking controller 70 is addressed during a read cycle. One input 85 of the latch 83 is driven by an AND gate 84 which has four inputs connected to data output ports on the respective pulse generators 77–80. As will be explained in more detail below, each pulse generator 77–80 applies a logic high voltage to the AND gate 84 when it is prepared to receive data from the drink processor or after a system reset has occurred. The drink processor can, therefore, read this single bit from the status latch 83 to determine if it can begin writing data to the data latch 81. Similarly, a second output port on each pulse generation 77–80 connects to four additional inputs 86 on the status latch 83. These signals can be read by the drink 20 processor and they indicate if each pulse generator 77–80 is ready to receive new pulse period or new pulse duty cycle data. These signals are necessary to insure that the pulse cycle is expecting the same type of data (i.e. pulse period or duty cycle) that the drink processor is producing.

Each pulse generator 77–80 is a programmed microcomputer. A model MC68701 is employed and it contains read only memory for storing its operating programs and random access memory for storing data. It also includes an 8-bit output port, and these eight output ports on each pulse generator 77–80 are connected to respective drivers 87–90. The eight drivers in each set 87–90 are thus separately controlled by a pulse generator, and the output of each driver connects to a solenoid coil 421 in the inking system (FIG. 3). When an output from a pulse generator 77–80 is driven high, its associated driver is enabled and produces current which energizes its associated solenoid coil 421. As explained above, when the solenoid coil 421 is energized, ink is supplied to a column of the ink rail 430, and hence, a column of the ink roller 23. On the other hand, when the pulse generator output is turned off, its associated solenoid coil 421 is de-energized and the ink supply is turned off for that column.

The operation of the inking system controller 70 will now be explained with reference to FIGS. 6 and 9. After power-up or reset, a 16-bit pulse period number and 16-bit duty cycle number is written to each of the columns 1–8 in each of the pulse generators 77–80. The drink processor accomplishes this by addressing the appropriate location $300700 through $3007FF and writing the 16-bit number to data latch 81. As a result, the addressed pulse generator 77–80 is interrupted and it reads the 16-bit number from the data latch 81 and stores it in its internal random access memory. When interrupted, the pulse generator 77–80 also sets its "busy" bit in the status latch 83 to indicate to the drink processor that it is reading the data. When this busy bit is reset, the drink processor is free to write the next 16-bit word to the same or a different pulse generator 77–80. At the completion of this process, sixty-four 16-bit numbers have been written to the pulse generators 77–80 which control the thirty-two separate solenoid coils 421.

Referring particularly to FIG. 9, when both the pulse period number and duty cycle number have been received by a pulse generator 77–80, the pulse generator presets a frequency counter 91 with the pulse period number, and it presets a duration counter 92 with the duty cycle number. An internal real time clock in each pulse generator 77–80 is then operable to generate an interrupt every one millisecond. The resulting interrupt service routine decrements each counter 91 and 92 by one count. If the frequency counter 91 is decremented to zero, its corresponding output is turned on to energize its corresponding solenoid coil 421 and it is again preset to the pulse period number. If the duration counter 92 has reached zero, its corresponding output is turned off and its associated solenoid coil 421 is de-energized. The duration counter 92 is again preset with the duty cycle number when the frequency counter 91 is preset (i.e. at the beginning of the next cycle). Of course, this process is carried out for each of the eight columns in each of the four pulse generators 77–80 to provide precise control over the pulse frequency and pulse duration of each of the thirty-two solenoid coils 421.

Referring particularly to FIGS. 5 and 7, the speed interface circuit 64 couples the digital incremented speed feedback signal received from the speed sensor 36 to the PIT 60. The speed sensor 36 produces a logic high voltage pulse for each incremental movement of the web through the printing unit. In the preferred embodiment, a magnetic sensor model 10001 available from Airpax Corporation is employed for this purpose, although any number of position feedback devices will suffice. The speed sensor's signal is applied to a line receiver 95 which produces a clean logic level signal that is 25 applied to the input of a 4-bit binary counter 96. The counter 96 produces an output pulse each time sixteen feedback pulses are produced by the speed sensor 36. This overflow is applied to the clock terminal of a D-type flip-flop 97 which switches to a logic state determined by the logic state applied to its D input. The D input is in turn driven by a second flip-flop 98 which is controlled by the PCO output of the PIT 60 and the $\overline{Q}$ output of flip-flop 97.

When the press speed is to be sampled, a "1" is written to the PCO output of the PIT 60. This transition clocks the flip-flop 98 to set its Q output high and to thereby "arm" the circuit. As a result, when the next overflow of the 4-bit counter 96 occurs, the flip-flop 97 is set and a logic high voltage is applied to the PC2TIN and PC1 inputs of the PIT 60. The $\overline{Q}$ output of flip-flop 97 also goes low to reset flip-flop 98 and to thereby disarm the circuit. As long as input PC2TIN is high, an internal timer 100 in the PIT 60 is operable to measure the time interval. The input PC1 may be read by the microprocessor 42 to determine when a complete sample has been acquired. After sixteen feedback pulses have been received, the counter 96 again overflows to reset the flip-flop 97 and to thereby stop the timer 100 in the PIT 60. Input PC1 also goes low, and when read next by the microprocessor 42, it signals that a complete sample has been acquired and can be read from the PIT 60. The entire cycle may then be repeated by again writing a "1" to the PCO output of the PIT 60.

DESCRIPTION OF THE DATA STRUCTURES

Referring to FIGS. 5 and 8, the data structures which are employed by the preferred embodiment of the present invention to control the inking systems 29 are stored in the RAM 50 of the drink processors. As indicated above, these data structures are collectively referred to as the switch database 51 and the control database 52. The structure of these two databases 51 and 52 are illustrated in FIGS. 8A–C for one printing couple. Similar data is stored in the databases 51 and 52 for the other printing couples in the unit 10.

The switch database 51 is an image of the switch states on the local switch panel 53 (FIG. 5). The operator may depress a pre-ink switch, for example, and this state change is indicated in the switch database 51 at 141. Similarly, if the color of the ink is to be changed and the old ink purged from the inking system, then the operator depresses a switch on the switch panel 53 which is reflected as a state change at 142. An ink enable switch state is indicated at 143 and this enables the operator to turn off the inking system while the press is operating. As will be explained below, the switch database 51 is periodically updated with state changes from the local switch panel 53 and with changes that may be requested by messages received from the master workstation 11 (FIG. 1). Other data structures pertaining to the dampening control system for the printing unit 10 are also stored in the switch database 51, but these will not be discussed in any detail in this specification.

The data structures in the control database 52 which are required by the inking system 29 are also illustrated in FIG. 8A. These include an ink roller period number 144 which is calculated periodically using the press speed feedback signal. The number 144 indicates the time period for the ink roll 23 to make one complete revolution. A color change timer 145 is also stored in the control database 52 and it is used in the ink purge procedure to time its sequence of steps. The color change timer 145 is set to a value as part of the purge procedure carried out during a color change, and it is decremented by one count every 10 milliseconds.

The majority of the control database 52 is comprised of ink volume records 146 and column data blocks 147. The ink volume records 146 are shown in more detail in FIG. 8B, and are comprised of one hundred and one separate records identified as $P_0$ through $P_{100}$. Each record $P_0$- $P_{100}$ corresponds to an ink volume number ($P=0$ through $P=1.00$) and it includes a corresponding duty cycle number 148 and a pulse period number 149. The duty cycle number 148 and pulse period number 149 are calculated to produce the amount of ink required by their associated ink volume P. These numbers may be derived imperically for each press, although a general relationship between ink volume P and the numbers 148 and 149 does exist, as will be explained in more detail below.

There are eight column data blocks 147 and each of these stores seven numbers as shown in FIG. 8C. These include an element status word 150 which is used by the drink processor to determine the state of the control of the corresponding solenoid coil 421. For example, the element status word 150 indicates that an ink volume change is not being carried out (IDLE), or an ink volume change has been requested by the message handler process (CHANGE IN PROGRESS), or a requested change has been output to the inking system controller 70 (FIG. 5) (CHANGE COMPLETE). The use of this element status word 150 will be described below in connection with the operation of the message handler process and the inker control process.

The column data blocks also store words which indicate the current ink volume (P) 151, the current pulse period 152 and the current duty cycle 153 being used by the inking system controller 70 to operate the solenoid coil 421 that corresponds to this column number. A desired ink volume word 154, desired pulse period 155 and desired duty cycle 156 are also stored in each block 147, and these store the latest ink volume command (P) received from the inker message handler process and the corresponding calculated pulse period (Q) and duty cycle ($T_{on}$). When the current values are not equal to the desired values, action is indicated and is carried out by the inker control process as will be described below.

DESCRIPTION OF THE SOFTWARE

As indicated above with respect to FIG. 5, the programs which direct the operation of the microprocessor 42 and, hence, control the operation of the drink processor 35 are stored in the ROM 44. As shown diagrammatically in FIG. 10, these programs include a set of programs which carry out specific tasks or processes as well as a real time clock interrupt service routine and an operating system program. The operating system program is indicated by block 200 and it is a commercially available program for the model 68000 microprocessor. It is responsible for the orderly allocation of processor time to each of the other programs. In the preferred embodiment, the operating system 200 is a real-time, multi-processing operating system kernel commercially available from Software Components Group, Inc. under the trademark "pSOS-68K". The operating system 200 acts as a nucleus of supervisory software which performs services on demand, schedules the running of other programs, manages and allocates resources, and generally coordinates multiple, asynchronous real-time activities.

Most of the programs are processes which carry out specific tasks. These processes can be in any one of three states: running; ready; or blocked. A ready process is one which can be run. Since only one ready process can be running at a given time on the microprocessor 42, the others must wait their turn. A ready process is allowed to run when its priority is higher than all the other ready processes. A running process is one that is being executed even if it is momentarily interrupted by a real time clock interrupt routine 201 or it makes calls to I/O service routines. A process becomes blocked as a result of a deliberate action on the part of the process itself which causes it to wait. For example, a process is blocked if it requests a message from an empty message queue, requests memory which is not presently available, waits for an event which is presently not pending, or pauses for a specified time interval. A blocked process becomes ready when a blocking condition disappears or is removed.

As indicated above, the ready process having the highest priority is allowed to run. When a process enters the ready state, the operating system 200 places it in a ready list which is stored in the RAM 50 at a location which reflects its priority relative to the other processes on the ready list. The operating system will normally run the process at the top of this ready list when it returns to the application programs.

Figure 10:
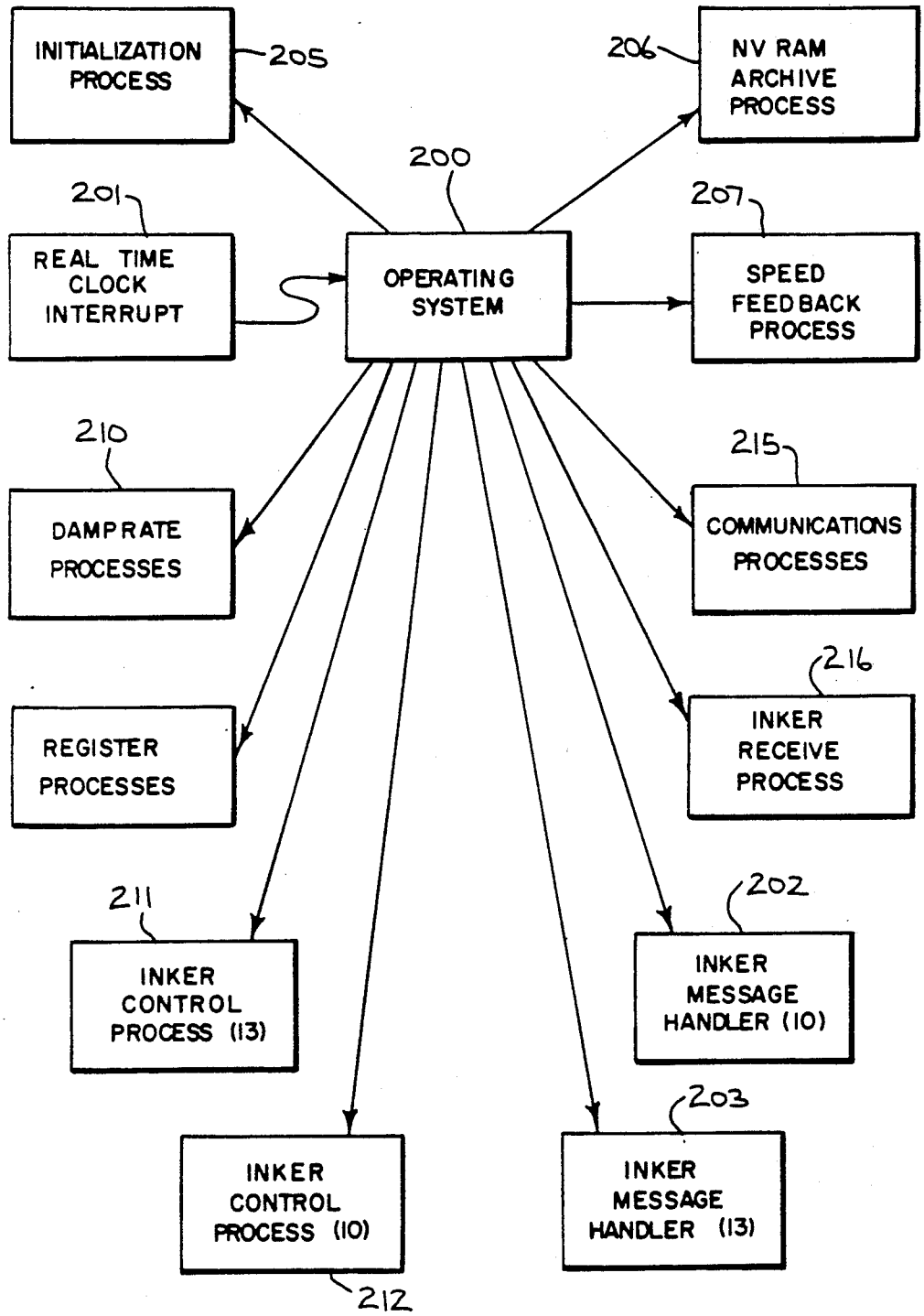
FIG. 10 is a block diagram which illustrates the various software modules that are used to control the drink processor of FIG. 5.

Referring still to FIG. 10, during power-up an initialization process 205 is ready to run and is executed first. The initialization process creates, or spawns, the other processes for the operating system 200 and it establishes the data structures described above. In addition, a number of diagnostic functions, such as memory checks and hardware checks are performed, and the programmable interface timer (PIT) 60 and inking system controller 70 are configured to operate as described above. And finally, the various system processes are activated so that upon return to the operating system 200, it will begin to run the highest priority process which is in the ready state.

One of these processes is the NVRAM archive process 206 which is executed each time it is signaled by another process that a change has been made in data which is archived. This program transfers data in the control database 52 to a nonvolatile memory (not shown in the drawings) where it is available for use when restarting after loss of power. After transferring the data, the process 206 blocks itself and returns to the operating system 200.

The real time clock interrupt routine 201 is executed every 25 milliseconds in response to an interrupt from a real time clock. The real time clock is formed by a counter in the DUART 55 (FIG. 5) which produces an interrupt request signal for the microprocessor 42 on a line 66 every 25 milliseconds. In response, the microprocessor 42 is vectored to the interrupt service routine 201 which records the passage of one or more increments of time. In addition, the service routine 201 decrements the time other processes have remaining before being reawakened. If, as a result, the wait time for any blocked process is decremented to zero, that process is unblocked and placed in the ready state by the real time clock interrupt. Thus, any process in the system may block its own execution for a selected time interval and the interrupt service routine 201 will unblock it after that time interval has expired.

Referring still to FIG. 10, a speed feedback process 207 is executed each time a real time clock interrupt is received and processed by the interrupt routine 201. In addition to reading the current speed from the PIT 60 every 100 milliseconds and initiating the taking of another speed sample, this routine reads the switches on the switch panel 53 every 100 milliseconds through the PIT 60. The instantaneous press speed value 131 is stored in the control database 52 and if the press speed has changed by ±0.5%, an event is signaled to a number of processes, including damprate processes indicated collectively at block 210 and inker control processes 211 and 212. The switch states are stored in the switch database 51, and if a change has occurred, an event is signaled to one of the inker message handlers 202 or 203, or one of the damprate processes 210. The speed feedback process 207 will be further described below with respect to FIG. 11.

Referring to FIGS. 4 and 10, communications through the serial channel 31 with the communications processor 30 is handled by send and receive processes which are indicated collectively by the block 215 entitled "communications processes". The receive process inputs message data which is received through the DUART 55. When a message has been received, it checks the "destination" field of the message to determine if it is directed to the inkrate control, color register or damprate control on this drink processor 35. If not, an error reply message is created and passed to the send process for transmission back to the processor 30 through the serial link 31. Proper messages are stored in the receive message buffer 49 and the message is posted to the appropriate damprate receive process, register receive process or inker receive process 216.

The send process creates outgoing messages and transmits them through the DUART 55 and serial link 31 to the communications processor 30. Message data is read from the send message buffers 66 and assembled into a message which conforms to the serial link protocol. After sending the message, the send process suspends itself and remains suspended until another process places a message in the send message buffer 66 and signals the send processor of the event.

Referring to FIG. 10, the inker receive process 216 handles all messages in the receive message buffer 49 which are intended for inkrate control. It validates the message and then processes it in accordance with the message's "function" field. Messages which change the inkrate control values are passed to the inker message handler 202 or 203 which is then activated by the inker receive process 216.

Read request messages which seek current information from the control database 52 are handled directly by the inker receive process 216. The requested information is read from the control database 52 and placed in the send message buffer 66. The process 216 then activates the communication process (send) 215. When all incoming messages have been processed, the inker receive process 216 becomes blocked until a new message is placed in the receive message buffer for it.

Each inker message handler 202 and 203 coordinates the flow of data incoming from both the speed feedback process 207 and the inker receive process 216 for one printing couple (side 10 or side 13). Each is responsible for directing the corresponding inker control process 211 or 212 to carry out the indicated function or change. It is also responsible for obtaining responses back from the inker control process 211 or 212 that a function has been executed or that a change has been completed, and for formulating a corresponding responsive message. Responsive messages which indicate that a function has been performed or that a change in operating conditions has been completed are placed in the send message buffer 66 and the communications process (send) 215 is activated. The operation of the inker message handler 202 and 203 will be described in more detail below with respect to FIG. 12.

Referring still to FIG. 10, the inker control processes 211 and 212 determine the pulse period and duty cycle for each solenoid valve in the inking system. There is an inker control process for each printing couple in the unit 10. As will be described in more detail below, the inker control process 211 calculates the pulse period and duty cycle for each solenoid 421 and writes the results to the inking system controller 70. This calculation is performed each time the speed feedback process 207 indicates that press speed has changed by setting an update flag 130 in the control database 52. These calculations are also performed each time the desired inking volume (P) for a particular column number is changed by a received message. This value, as well as others, can be manually changed by sending "change" messages which are passed to the inker control process 211 or 212 by its associated inker message handler 203 or 202. After the change has been implemented, the inker control process 211 or 212 signals this event to its message handler 203 or 202, which, in turn, initiates a responsive message as described above. The inker control process will be described in more detail below with reference to FIG. 13.

Figure 11:
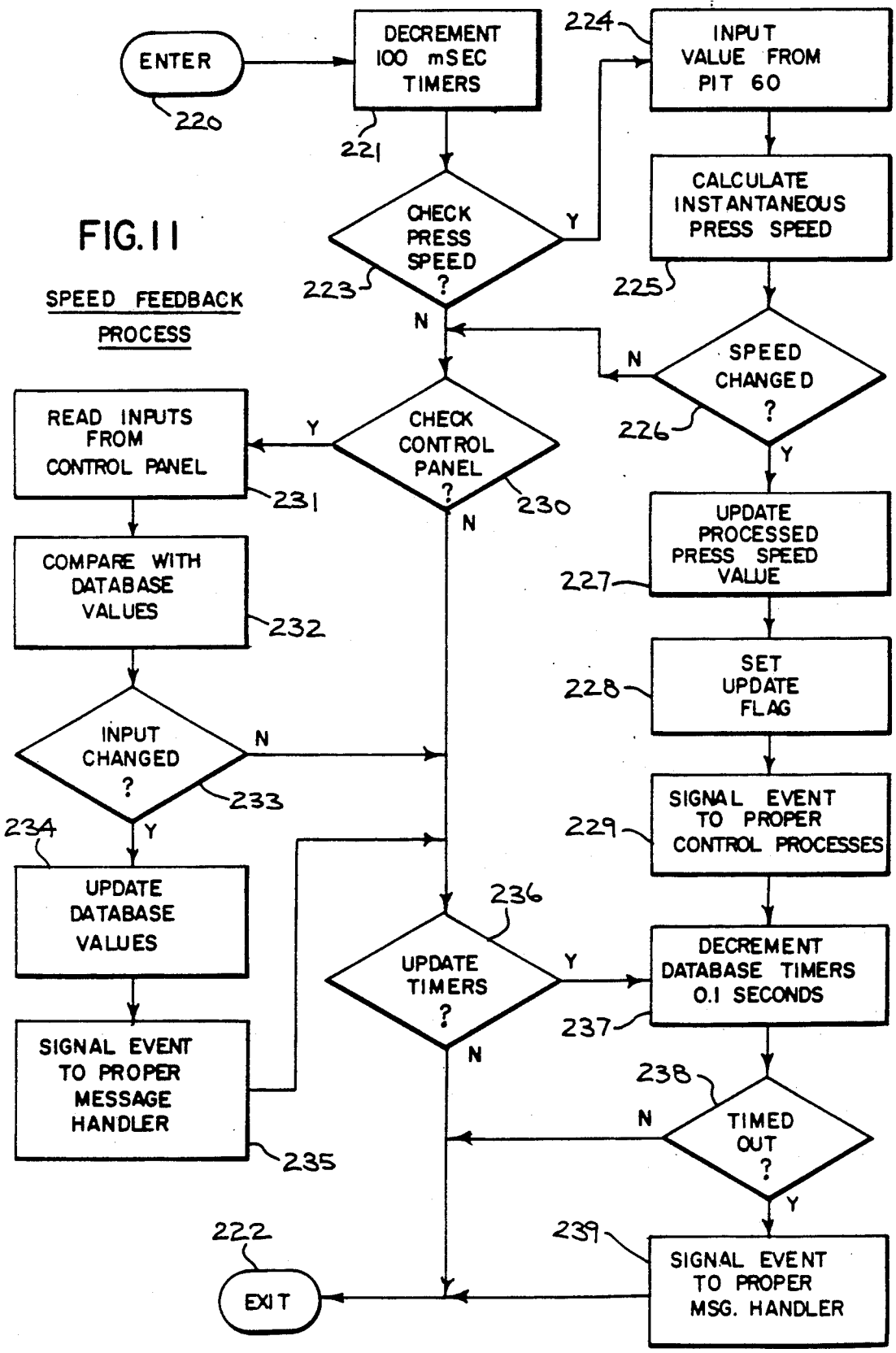
FIG. 11 is a flow chart of the speed feedback process which forms one of the modules of FIG. 10.

Referring particularly to FIGS. 8 and 11, the speed feedback process 207 is unblocked every 25 milliseconds by the real time clock interrupt 201. When run, this process enters at 220 and decrements three 100 msec. timers as indicated by process block 221. One of these timers measures the interval between updates to press speed, another measures the interval between control panel scans, and the third measures 100 msec. "tics" on a variety of software timers. If none of these timers is decremented to zero, the process blocks itself for another 25 milliseconds and exits at 222 back to the operating system 200.

Every 100 milliseconds the press speed is checked. The process branches at decision block 223 when the appropriate timer expires and the value of the timer 100 in the PIT 60 (FIG. 7) is read into the microprocessor 42 as indicated at process block 224. A new press speed sampling cycle is also initiating by writing a "1" to the PCO output of the PIT 60. Using the timer value, the instantaneous press speed is calculated at process block 225 by dividing the timer value into a constant which represents the distance moved by the press to produce sixteen incremental feedback pulses. The value is stored as the instantaneous press speed 131 in the control database 52. A check is then made at decision block 226 to determine if the press speed has changed enough to warrant an update of the processed press speed 132. This is accomplished by determining if the absolute difference between instantaneous press speed and processed press speed is greater than 0.5% of one hundred percent press speed. If not, the process branches back, otherwise, the processed press speed value 132 is updated with the instantaneous press speed value 131 as indicated at 227. In addition, the update flag 130 is set as indicated at block 228 and the effected control processes are signaled of the event as indicated at process block 229.

Referring still to FIGS. 8 and 11, if the control panel timer has expired as determined at decision block 230, feedback process 207 reads the inputs from the switch panel 53 as indicated at 231. This is accomplished by reading the 8-bit PB port on the PIT 60 (FIG. 5). The individual switch status bits are then masked out and compared at block 232 with the corresponding switch status bits in the switch database 51. If none of the switches have changed, the process branches at decision block 233. Otherwise, the changed switch status is updated in the switch database 51 at block 234 and the switch change event is signaled at block 235 to the proper inker message handler process 202 or 203 or damprate message handler 210.

And finally, if a 0.1 second tic has occurred, the feedback process 207 branches at decision block 236 to decrement the color change database timer value 145, as indicated at process block 237. If any such timer is reduced to zero, as determined at decision block 238, the appropriate message handler process is signaled at 239 that an event has occurred. For example, if the color change timer 145 is decremented to zero, this event is signaled to the inker message handler 202 or 203 for that printing couple. The functions performed by the speed feedback process 207 are then complete and the system exits at 222 back to the operating system 200.

The inker message handler 202 or 203 runs only when it is signaled by the speed feedback process 207 that a switch has changed state, or when it is signaled by the inker receive process 216 that a change request, PRE-INK request or COLOR CHANGE request message has been received, or when the inker control process 211 or 212 signals that a previous request has been completed.

Figure 12:
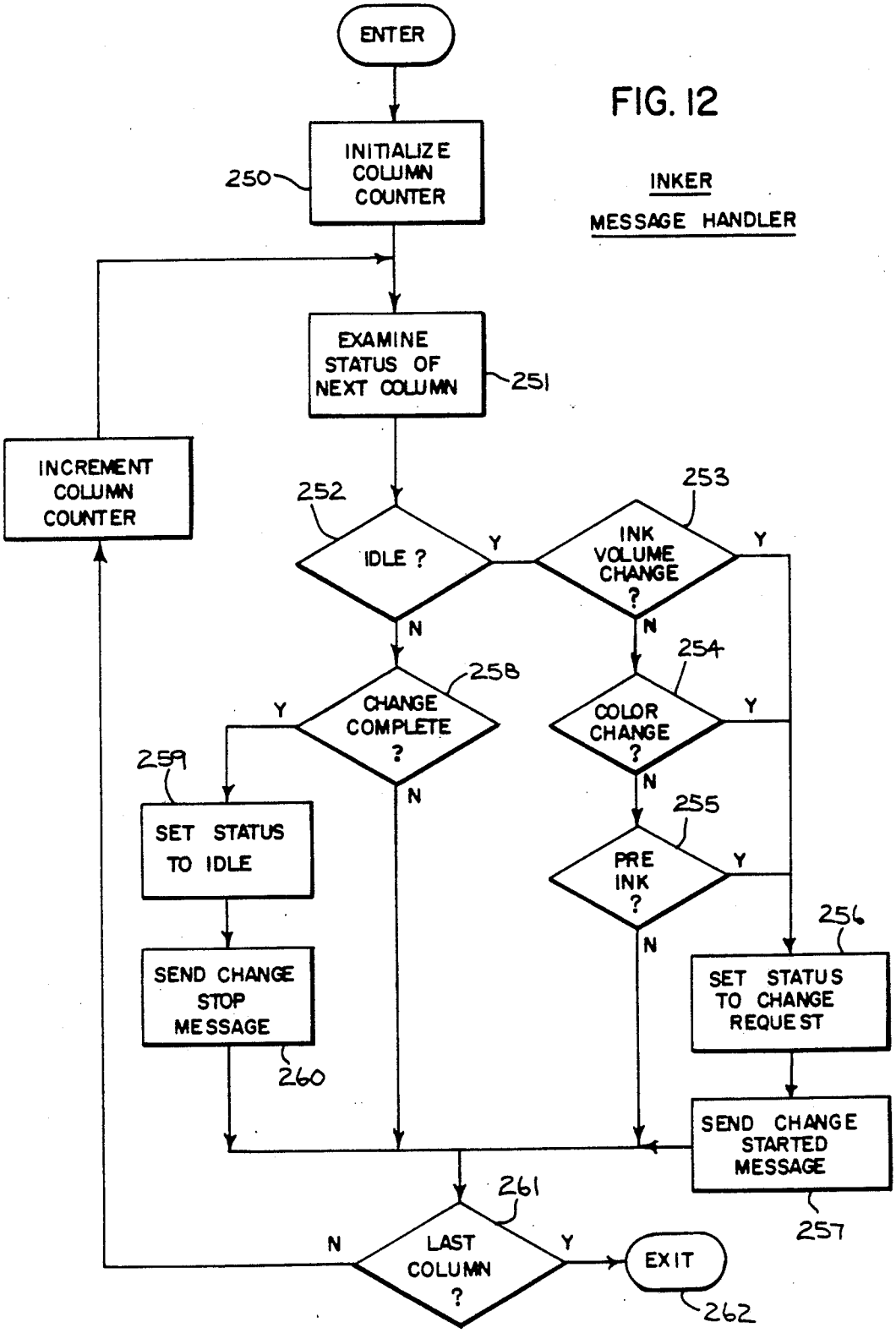
FIG. 12 is a flow chart of the inker message handler which forms two of the modules of FIG. 10.

Referring particularly to FIGS. 8 and 12, when the inker message handler 202 or 203 runs, it first initializes a column counter as indicted at process block 250 to point to the first column data block 147. A loop is then entered in which the element status 150 is examined at process block 251 and an action is taken based on its contents. If the inking column is idle, as indicated at decision block 252, tests are made at decision blocks 253–255 to determine if a change is to be made for this print column. First, the column data block is examined at 253 to determine if the desired ink volume value 154 is different than the current ink volume value 151. If it is, a change is required and the element status 150 is changed at process block 256 to indicate the "CHANGE REQUEST" state. Similarly, if a color change or pre-ink procedure has been requested, the status is changed and a CHANGE STARTED message is created at process block 257. The CHANGE STARTED message is passed to the communications process 215 (FIG. 10) for sending to the master work station 11 (FIG. 1).

If the print column is not in idle as determined at decision block 252, a test is made at decision block 258 to determine a previously initiated change has been completed. If so, the element status word 150 is set to indicate IDLE at process block 259 and a CHANGE STOP message is created at process block 260 and is passed to the communications process 215. All thirty-two elements for the print couple are processed in this manner, and when the last element has been processed, as indicated at decision block 261, the system exits back to the operating system at 262.

Figure 13:
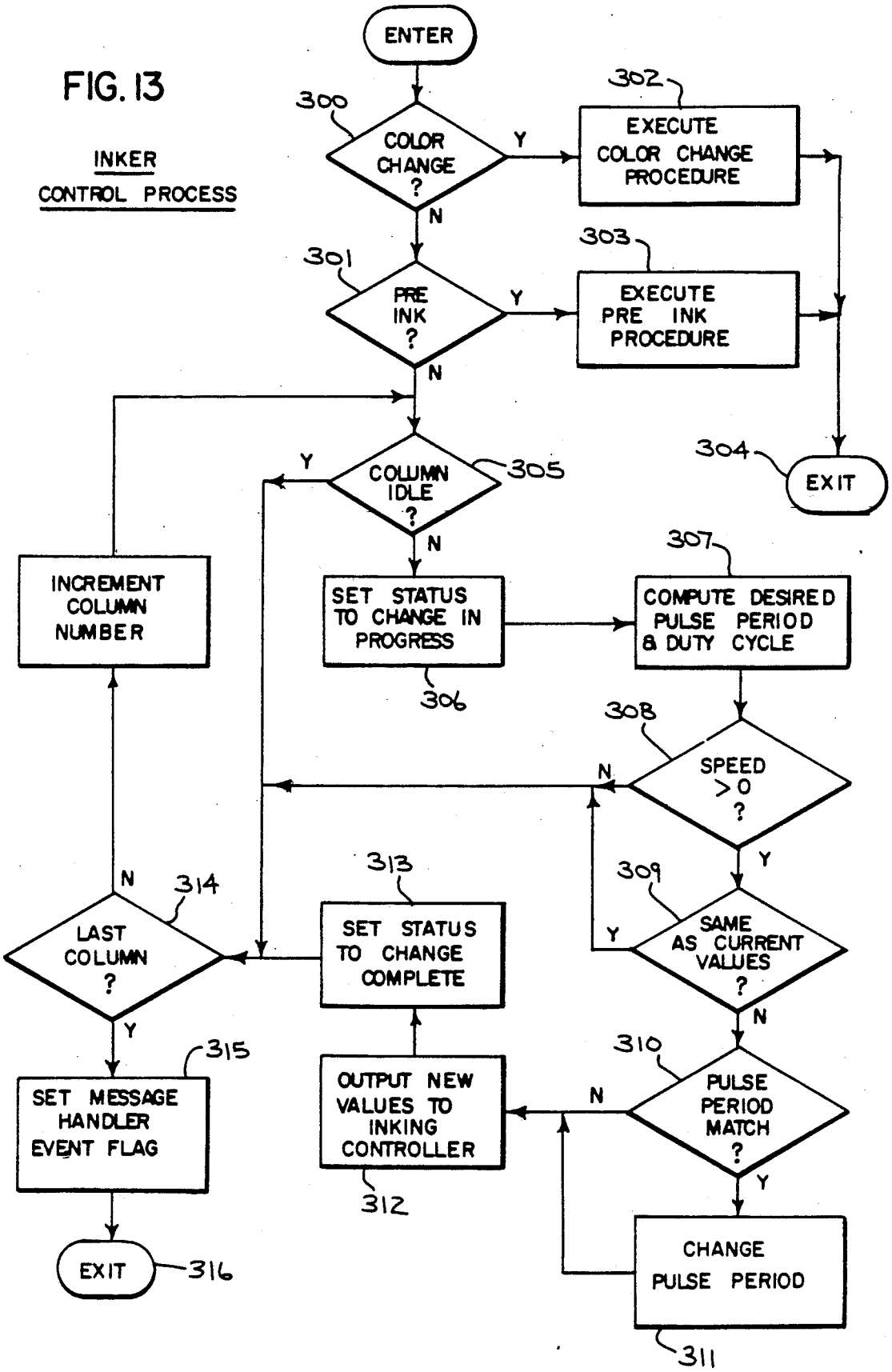
FIG. 13 is a flow chart of the inker control process which forms two of the modules of FIG. 10.

Referring to FIGS. 8 and 13, the inker control processes 211 and 212 are run when an event is signaled by the speed feedback process 207 or the associated inker message handler 202 or 203. As indicated above, the speed feedback process periodically updates the processed press speed 132 in the control database 52 and signals the inker control process of this event. Similarly, when a COLOR CHANGE OR PRE-INK switch closure occurs, or when a message is received which changes the desired ink volume or requests a color change or pre-ink, the inker message handler signals the inker control process of this event. The inker control process operates the elements of the inking system controller 70 to carry out a change in pulse period and pulse duty cycle.

Referring particularly to FIGS. 8 and 13, when the inker control process is run, a check is made at decision blocks 300 and 301 to determine if either a color change or a pre-ink has been requested. If so, the corresponding procedure indicated very generally by respective process blocks 302 and 303 is executed and the program exits back to the operating system at 304. Otherwise, a loop is entered at decision block 305 in which each print column is checked to determine if it is in the IDLE state. If not, the element status word 150 is set to CHANGE IN PROGRESS at process block 306, and the desired pulse period and desired duty cycle is calculated from the desired ink volume (P) at process block 307. The manner in which these calculations are carried out will be discussed in more detail below.

After computing the desired pulse period and desired duty cycle, tests are made at decision blocks 308–310 to determine if these should be output to the inking system controller 70. At decision block 308, the processed press speed is checked to make sure it is moving before the inking system is turned on, and at decision block 309 a test is made to insure that the calculated values are different than the current values 152 and 153 in the column data block 147. And finally, the desired pulse period is compared with the ink roller period 144 at decision block 310 to determine if it is substantially the same or a multiple of the ink roller period. If so, the desired pulse period is changed at process block 311 to a value which is 10% greater and a corresponding 10% change in the duty cycle is made to maintain the desired ink volume (P). These changes are made to insure that ink is not injected onto ink roll 23 (FIG. 3) at the same location during each of its revolutions.

Referring still to FIG. 13, the desired pulse period and the desired duty cycle are now output to the inking system controller 70 at process block 312. As explained above with reference to FIG. 6, the status latch 83 is read first to determine if the controller 70 is prepared to accept the data, and then the values are written to the data latch 81. When both values have been accepted by the controller 70, they become effective immediately and the amount of ink produced by the print column changes to the desired ink volume. As indicated at process block 313, the current volume 151, the current pulse period 152, and the current duty cycle 153 are changed to equal their corresponding desired values and the element status 150 in the column data block 147 is changed to CHANGE COMPLETE.

After all columns of the print couple have been processed in this manner, the system branches at decision block 314. As indicated at process block 315, the final step is to set the event flag for the inker message handler 202 or 203 to alert it to the fact that the change which it initiated has been acted upon. The inker control process then exits at 216 back to the operating system.

An important aspect of the present invention is the manner in which the pulse period (Q) and the duty cycle ($T_{on}$) are calculated as a function of the ink volume command (P). The total ink flow applied to each column of the moving web is represented by:

$$Z=KND \tag{1}$$

where:

K=a constant between 0 and 1 which is determined experimentally during press set up.

N=coverage reading from a printed area coverage subsystem, and which ranges from 0 to 1. If the print image occupies one-half the area, the coverage reading is 0.5.

D=the total ink flow produced by the pump for each column.

The quantity KN is the ink volume number (P) which is used to control the inking system as described above, and it represents the fraction of the total pump output (D) which is to be applied to the web for that column. That is:

$$P=T_{on}/(T_{on}+T_{off}) \tag{2}$$

where:

$T_{on}$=the duty cycle number in milliseconds, or the time period the valve is to be "on" and ink applied to the ink roll 23.

$T_{off}$=the time in milliseconds the ink from the pump is diverted away from the ink roll 23.

$T_{on}+T_{off}$=*the total pulse period (Q)*

Because the ink pumps 415 (FIG. 3) are operated at a speed proportional to press speed, for any given ink volume number (P) the pulse period (Q) and the duty cycle ($T_0$) remains constant as long as the pump is turning. Therefore, for any given ink volume number (P) which is input to the ink control system for a given column, a single value for the pulse period (Q) and duty cycle ($T_0$) is computed and used for control as described above at all press speeds.

Since the ink is applied to the ink roll 23 as a series of pulses, the total pulse period (Q) must never be long enough to cause variations in print density. On the other hand, the total pulse period (Q) cannot be too short or the valve 420 cannot be turned on and off fast enough or will undergo unnecessary wear. The values for the total pulse period (Q) for the given values of ink volume number (P) is determined by extensive print testing. This is accomplished for each given value of ink volume number (P) by decreasing the pulse period (Q) until there is no discernable variation in the density of the printed image. This process is repeated for ink volume values (P) ranging from 0.01 to 1.00 in 0.01 increments, and the resulting pulse periods (Q) are stored in the ink volume record 146 (FIG. 8B). The corresponding duty cycle number ($T_0$) is then computed for each ink volume number (P) and pulse period (Q) as follows:

$$T_{on}=PQ \tag{3}$$

In one preferred embodiment of the invention, therefore, the pulse period values (Q) are determined experimentally for each of a finite number (100 in the preferred embodiment) of ink volume numbers (P) and the corresponding duty cycle numbers ($T_0$) are calculated and stored as shown in FIG. 8B.

Where higher accuracy is required in the control of ink application, the values of pulse period (Q) and duty cycle ($T_0$) may be calculated from the ink volume command (P). Where the ink volume command (P) is greater than 0.5, the time in which the valve 420 must remain in a position permitting ink to flow through to the ink roll 23 is given by the equation:

$$T_{on}=T_{min}(P)/(1-P) \tag{4}$$

where:

$T_{min}$=a preselected time interval the valve must remain open so as not to exceed its physical speed limits. The pulse period (Q) is then calculated as follows:

$$Q=T_{on}/P \tag{5}$$

On the other hand, if the ink volume command (P) is less than 0.5, then the amount of time that the valve must remain off ($T_{off}$) to divert ink away from the ink roll 23 is given by the following:

$$T_{off}=T_{min}(1-P)/P \tag{6}$$

From equation (2) above the duty cycle ($T_{on}$) can then be calculated as follows:

$$T_{on}=T_{off}/(1-P) \quad (7),$$

and the pulse period (Q) can be calculated according to equation (5) above. These relationships are illustrated in FIG. 14 where $T_{on}$ is plotted as a function of ink volume command (P) and $T_{off}$ is plotted as a function of ink volume command.

What is claimed is:

1. An inking apparatus for supplying ink to a roll on a press, including a roll defining a plurality of print columns disposed along its length which are to be inked simultaneously, said apparatus further comprising:

(a) a supply of ink;

(b) positive displacement ink pump means having an inlet side and an outlet side, said inlet side being connected to said supply of ink;

(c) an ink rail positioned adjacent said roll and having a set of ink outlet orifices positioned to supply ink to each of said print columns;

(d) ink conduit means connecting the outlet of said pump means with each outlet orifice in said ink rail;

(e) valve means connected in said ink conduit means between said pump means and said ink rail to permit the flow of ink from said ink pump means so as to separately control the flow of ink to each of said ink outlet orifices in said rail in time discharges;

(f) ink by-pass means to conduct ink from said valve means to a site upstream from the inlet of said ink pump means; and (g) control means, connected to said valve means, which is responsive to an ink volume command (P) for each of said print columns to produce output signals which are applied to the valve means and which separately control the timed discharge of ink to each of said ink outlet orifices.

2. The inking apparatus of claim 1 in which the control means calculates the time interval ($T_{on}$) in which the ink is to be discharged to one of said ink outlet orifices from the equation:

$$T_{on}=T_{min}(P)/(1-P)$$

where:

$T_{min}$=a preselected time interval the valve must remain open so as not to exceed its physical speed limits; and P=an ink volume command having a value less than 0.5.

3. The inking apparatus of claim 1 in which the control means calculates the time ($T_{on}$) in which the ink is to be discharged to one of said ink outlet orifices from the equations:

$$T_{on}=T_{off}(1-P)$$

and $$T_{off}=T_{min}(1-P)/P$$

where:

$T_{min}$=a preselected time interval the valve must remain open so as not to exceed its physical speed limits; and P=an ink volume command having a value less than 0.5.

4. The apparatus as recited in claim 1, which includes means for acquiring a coverage reading number (N) which indicates the fraction of the area in a print column that is to be covered with ink, and the ink volume command (P) is determined in part by the value of the acquired coverage reading number (N).

* * * * *